United States Patent [19]

Akiyama et al.

[11] 4,268,626

[45] May 19, 1981

[54] DRY IMAGE FORMING MATERIAL

[75] Inventors: Minoru Akiyama; Kageyasu Akashi; Tetsuo Shiga; Yoshinobu Ito; Takeo Kimura; Takeki Matsui, all of Fuji, Japan

[73] Assignee: Asahi Kasei Kogyo Kabushiki Kaisha, Osaka, Japan

[21] Appl. No.: 66,739

[22] Filed: Aug. 15, 1979

[30] Foreign Application Priority Data

Aug. 28, 1978 [JP] Japan ..... 53-103914

[51] Int. Cl.[3] ..... G03C 1/02

[52] U.S. Cl. ..... 430/620; 430/353; 430/619; 430/618

[58] Field of Search ..... 430/353, 618, 619, 620

[56] References Cited

U.S. PATENT DOCUMENTS

| | | | |
|---|---|---|---|
| 3,080,254 | 3/1963 | Grant | 430/346 |
| 3,113,496 | 9/1978 | Shiga et al. | 430/618 |
| 3,761,279 | 9/1973 | de Mauriac et al. | 430/353 |
| 3,764,329 | 10/1973 | Lee | 430/353 |
| 3,770,448 | 11/1973 | Poot et al. | 430/619 |
| 3,846,136 | 11/1974 | Sullivan | 430/353 |
| 4,120,728 | 10/1978 | Ikenoue et al. | 430/618 |
| 4,144,072 | 3/1979 | Ikenoue et al. | 430/353 |

*Primary Examiner*—Jack P. Brammer

*Attorney, Agent, or Firm*—Sprung, Felfe, Horn, Lynch & Kramer

[57] ABSTRACT

A novel dry image forming material comprising (a) a non-photosensitive organic silver salt oxidizing agent, (b) a reducing agent for silver ions, (c) a photosensitive silver halide or a photosensitive silver halide-forming component capable of forming a photosensitive silver halide by the reaction thereof with said organic silver salt oxidizing agent, and (d) a substituted 3-pyrazolin-5-one. The dry image forming material has improved sensitivity and storage stability of the raw image forming material and can form thereon an excellent black tone image.

7 Claims, No Drawings

DRY IMAGE FORMING MATERIAL

This invention relates to a novel dry image forming material. More particularly, this invention relates to a dry image forming material containing a novel toning agent capable of serving to provide an excellent black tone image and of imparting improved storage stability and sensitivity to the raw image forming material.

The conventional silver halide image forming method which has heretofore been most widely practiced is a wet method in which some kinds of liquids are used for development and subsequent fixation or stabilization. This method is disadvantageous in that it includes complicated treatment processes, requiring a considerable skill for practicing the method. For this reason, there have been many attempts to develop dry methods which are practiced without involving treatments with liquids. As a result, there have been proposed silver salt type image forming materials on which an image can be formed only by a dry process. As such image forming materials, there are, for example, image forming materials using an oxidation-reduction image forming combination comprising a non-photosensitive organic silver salt oxidizing agent such as the silver salt of a long chain fatty acid, saccharin or benzotriazole with a reducing agent for silver ions, a silver halide as a photosensitive catalyst and the like. These image forming materials are characterized in that they can be developed by heating.

The dry image forming materials of silver salt type include those containing a photosensitive silver halide which are photosensitive under normal lighting conditions (hereinafter often referred to as "normally photosensitive image forming material") and those which are non-photosensitive under normal lighting conditions (hereinafter often referred to as "normally non-photosensitive image forming material"), such as disclosed in U.S. Pat. Nos. 3,764,329, and 4,113,496 and Deutsche Offenlegungsschrift No. 2811557. The latter image forming materials can be handled under a room light provided they are not activated, and can be rendered photosensitive when they are activated, for example, by heating the same prior to exposure to light. The former image forming materials can form thereon a visible image when subjected to imagewise exposure to light and subsequent heat development, whereas the latter image forming materials can form thereon a visible image when subjected to preliminary activation, imagewise exposure to light and subsequent heat development.

However, it is well known to those skilled in the art that, where a dry image forming material which is either normally photosensitive or normally non-photosensitive as described above does not contain a toning agent, a satisfactory clear image can not be formed on the material. Examples of the toning agents capable of serving to provide a clear image include phthalazinone as mentioned in U.S. Pat. No. 3,080,254, and succinimide, phthalimide and 2-pyrazolin-5-ones as mentioned in U.S. Pat. No. 3,846,136. However, the toning agents which have heretofore been proposed have such defects that they cannot serve to provide a good black tone image and that they give so poor storage stability to raw image forming materials containing the same that the image forming materials stored out of use for a long time have reduced sensitivity, form thereon an image having a suppressed tone and bring about fogging.

It is, therefore, an object of the present invention to provide a dry image forming material on which an excellent black tone image is obtained after heat development. Another object of the invention is to provide a dry image forming material having good storage stability prior to use of the material. It is still another object of the present invention to provide a dry image forming material having improved sensitivity.

We have made extensive investigations with a view to achieving the objects as mentioned above, and, as a result, have found that a dry image forming material containing a compound as specified below satisfies the above-mentioned objects. We have now completed the present invention based on this novel finding.

More specifically, in accordance with the present invention, there is provided a dry image forming material comprising (a) a non-photosensitive organic silver salt oxidizing agent, (b) a reducing agent for silver ions, (c) a photosensitive silver halide or a photosensitive silver halide-forming component capable of forming a photosensitive silver halide by the reaction thereof with said organic silver salt oxidizing agent, and (d) at least one member selected from the group consisting of compounds represented by the formula:

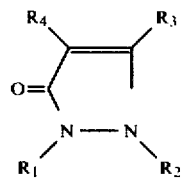

wherein $R_1$ is a hydrogen atom, a $C_1$–$C_5$ straight chain or branched alkyl group, an unsubstituted or substituted phenyl group or an unsubstituted or substituted $C_3$–$C_8$ cycloalkyl group; $R_2$ is a $C_1$–$C_5$ straight chain or branched alkyl group, an unsubstituted or substituted phenyl group or an unsubstituted or substituted $C_3$–$C_8$ cycloalkyl group; and $R_3$ and $R_4$ are the same or different and each represent a hydrogen atom, a $C_1$–$C_5$ straight chain or branched alkyl group, an unsubstituted or substituted phenyl group or an unsubstituted or substituted phenylalkyl group having a $C_1$–$C_5$ straight chain or branched alkyl moiety.

As the non-photosensitive organic silver salt oxidizing agent that is used as the component (a) in the dry image forming material of the present invention, the silver salts of long chain fatty acids, which preferably have 12 to 24 carbon atoms, are especially suitable. Preferred examples of the silver salts of long chain fatty acids include silver behenate, silver stearate, silver palmitate, silver myristate, silver laurate and silver oleate. As other suitable nonphotosensitive organic silver salt oxidizing agents, there can be mentioned, for example, the silver salts of saccharin, benzotriazole, 5-chloro or -nitro salicylaldoxime, phthalazinone and 3-mercapto-4-phenyl-1,2,4-triazole. They may be used either alone or in combination. The organic silver salt oxidizing agent may be used in an amount of about 0.1 to about 50 g/m$^2$, preferably 1 to 10 g/m$^2$ of the support area of the dry image forming material.

As the reducing agent that is the component (b) in the dry image forming material of the present invention, there is used an organic reducing agent which has such a suitable reducing ability that, when heated, it reduces the non-photosensitive organic silver salt oxidizing agent with the aid of catalysis of the silver halide produced in the exposed portions of the dry image forming material to form a silver image. Examples of the reducing agents include monohydroxybenzenes such as p-phenylphenol, p-methoxyphenol, 2,6-di-tert-butyl-4-methylphenol and 2,5-di-tert-butyl-4-methoxyphenol; polyhydroxybenzenes such as hydroquinone, tert-butylhydroquinone, 2,6-dimethylhydroquinone, chlorohydroquinone and catechol; naphthols such as α-naphthol, β-naphthol, 4-aminonaphthol and 4-methoxynaphthol; hydroxybinaphthyls such as 1,1'-dihydroxy-2,2'-binaphthyl and 4,4'-dimethoxy-1,1'-dihydroxy-2,2'-binaphthyl; phenylenediamines such as p-phenylenediamine and N,N'-dimethyl-p-phenylenediamine; aminophenols such as N-methyl-p-aminophenol and 2,4-diaminophenol; sulfonamidophenols such as p-(p-toluenesulfonamido) phenol and 2,6-dibromo-4-(p-toluenesulfonamido) phenol; methylenebisphenols such as 2,2'-methylenebis(4-methyl-6-tert-butylphenol), 2,2'-methylenebis(4-ethyl-6-tert-butylphenol), 2,2'-methylenebis-[4-methyl-6-(1-methylcyclohexyl)phenol], 2,4,4-trimethylpentylbis(2-hydroxy-3,5-dimethylphenyl) methane and 2,6-bis(2'-hydroxy-3'-tert-butyl-5'-methylbenzyl)-4-methylphenol; 3-pyrazolidones such as 1-phenyl-3-pyrazolidone and 4-methyl-4-hydroxymethyl-1-phenyl-3-pyrazolidone; and ascorbic acids. A suitable reducing agent may be chosen depending on the organic silver salt oxidizing agent employed in combination therewith. For example, when there is employed as the oxidizing agent the silver salt of a long chain fatty acid such as silver behenate which is relatively hard to reduce, a relatively strong reducing agent, e.g., a bisphenol such as 2,2'-methylenebis(4-ethyl-6-tert-butyl) phenol is suitably employed. On the other hand, to organic silver salt oxidizing agents such as silver laurate which are relatively easy to reduce are suitable relatively weak reducing agents, e.g., substituted phenols such as p-phenylphenol and to organic silver salt oxidizing agents such as the silver salt of benzotriazole which are very hard to reduce are suitable strong reducing agents such as ascorbic acids. The silver ion reducing agent that is especially suitable for the dry image forming material of the present invention is a hindered phenol in which one or two sterically bulky groups are bonded to the carbon atom or carbon atoms contiguous to the hydroxyl group-bonded carbon atom to sterically hinder the hydroxyl group. The hindered phenol has a high stability to light and, hence, the use of the hindered phenol is significant for securely maintaining the stability of an image forming material against post-fogging. In the case of a normally non-photosensitive image forming material, the use of the hindered phenol assures a high light stability of the raw image forming material. As examples of such hindered phenols, there can be mentioned 2,6-di-tert-butyl-4-methylphenol, 2,2'-methylenebis(4-methyl-6-tert-butylphenol), 2,6-methylenebis(2-hydroxy-3-tert-butyl-5-methylphenyl)-4-methylphenol, 2,2'-methylenebis(4-ethyl-6-tert-butylphenol), 2,4,4-trimethylpentylbis(2-hydroxy-3,5-dimethylphenyl)methane, 2,2'-methylenebis[4-methyl-6-(1-methylcyclohexyl)phenol] and 2,5-di-tert-butyl-4-methoxyphenol. These reducing agents may be used either alone or in combination. The amount of the reducing agent to be used varies depending on the kinds of organic silver salt oxidizing agent, reducing agent and other components to be used in the dry image forming material of the present invention. The suitable amount of the reducing agent is usually 0.1 to 3 moles per mole of the organic silver salt oxidizing agent.

The component (c) to be used in the dry image forming material of the present invention is a photosensitive silver halide or a photosensitive silver halide-forming component capable of forming a photosensitive silver halide by the reaction thereof with the organic silver salt oxidizing agent as the component (a). Examples of the photosensitive silver halide include silver chloride, silver bromide, silver bromoiodide, silver chlorobromide, silver chlorobromoiodide and silver iodide. They may be used either alone or in combination. Such a photosensitive silver halide as mentioned above may be formulated, together with other components, into a composition for providing the image forming layer of the dry image forming material. Alternatively, the photosensitive silver halide can be prepared in situ either in a composition for providing the image forming layer of the dry image forming material or in the coated image forming layer of the dry image forming material, by the reaction of a photosensitive silver halide-forming component with part of an organic silver salt oxidizing agent. As the photosensitive silver halide-forming component, any source of halogen ions may be used. Examples of sources of halogen ions include hydrogen halides such as hydrogen bromide and hydrogen iodide; metal halides such as sodium bromide, potassium bromide, calcium iodide, calcium bromide, barium iodide, lithium bromide, aluminum bromide, aluminum iodide, ferric bromide, zinc bromide, zinc iodide, cobaltous bromide, cobaltous iodide, lead iodide, lead bromide, mercuric bromide, mercuric iodide, nickel bromide, nickel iodide, palladium bromide, palladium iodide, cadmium bromide, cadmium iodide, magnesium bromide, manganese bromide and manganese iodide; halogen molecular species such as iodine, bromine and iodine bromide, and complexes of the halogen molecular species with triphenylphosphite or p-dioxane, such as tripheynylphosphite nonaiodide and bromine-p-dioxane complex (see Deutsche Offenlegungsschrift No. 2811557); organic haloamides such as N-bromosuccinimide, N-bromoacetamide, N-bromophthalazinone, N-bromophthalimide and N,N-dibromobenzenesulfonamide (see U.S. Pat. No. 3,764,329); diarylhalomethanes such as α-bromodiphenylmethane, α-bromodi(p-nitrophenyl) methane, α-bromodi(p-methoxyphenyl) methane, α-bromodi(p-bromophenyl) methane, α-bromodi(p-methylphenyl) methane and α-bromodi(p-phenylphenyl) methane (see U.S. patent application Ser. No. 922,463 filed on July 6, 1978 now U.S. Pat. No. 4,188,226); onium halides such as benzyltrimethylammonium iodide, benzyltriethylammonium bromide and cetyltrimethylammonium bromide; organometallic halides such as triphenylphosphine dibromide, bis(p-anisyl) tellurium dibromide, diphenylgermanium dibromide, triphenylgermanium bromide, triphenyltin bromide and diphenylselenium dibromide (see U.S. Pat. No. 4,113,496 in which there are mentioned as the metallic element of the organometallic halides germanium, tin, lead, phosphorus, arsenic, antimony, bismuth, selenium, tellurium and polonium); and dihalides of triphenylphosphites such as triphenylphosphite diiodide and triphenylphosphite dibromide. Of these, halogen molecular species and complexes thereof, organic haloamides, organometallic halides, diarylhalomethanes and combinations thereof are particularly useful as the photosensitive silver halide-forming component to provide a normally non-photosensitive dry image forming material which is rendered photosensitive by heating at an elevated temperature, e.g., about 70° C. or higher, by which heating the photosensitive silver halide-forming component is caused to react with part of the organic silver salt oxididing agent to form the silver halide in an amount sufficient to render the image forming material photosensitive. Either the photosensitive silver halide or the photosensitive silver halide-forming component may be used in an amount of 0.001 to 0.3 mole per mole of the organic silver salt oxidizing agent.

The component (d) to be used in the dry image forming material of the present invention is at least one member selected from compounds represented by the formula:

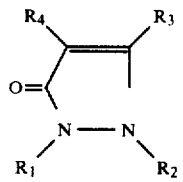

wherein $R_1$ is a hydrogen atom, a $C_1$–$C_5$ straight chain or branched alkyl group, an unsubstituted or substituted phenyl group or an unsubstituted or substituted $C_3$–$C_8$ cycloalkyl group; $R_2$ is a $C_1$–$C_5$ straight chain or branched alkyl group, an unsubstituted or substituted phenyl group or an unsubstituted or substituted $C_3$–$C_8$ cycloalkyl group; and $R_3$ and $R_4$ are the same or different and each represent a hydrogen atom, a $C_1$–$C_5$ straight chain or branched alkyl group, an unsubstituted or substituted phenyl group or an unsubstituted or substituted phenylalkyl group having a $C_1$–$C_5$ straight chain or branched alkyl moiety.

Preferred are those compounds of the above formula, wherein $R_1$ is a hydrogen atom, a methyl group, an ethyl group, a phenyl group, a substituted phenyl group substituted with 1 to 3 substituents selected from methyl, ethyl, chlorine, bromine and iodine, or a cyclohexyl group; $R_2$ is a methyl group, an ethyl group, a phenyl group, a substituted phenyl group substituted with 1 to 3 substituents selected from methyl, ethyl, chlorine, bromine and iodine, or a cyclohexyl group; $R_3$ is a hydrogen atom, a methyl group, an ethyl group or a phenyl group; and $R_4$ is a hydrogen atom, a methyl group, an ethyl group, an isopropyl group, a phenyl group, a p-methylphenyl group or a benzyl group.

Specific examples of the above-mentioned compounds that are suitable as the toning agent include:

Compound 1

2-Phenyl-3-pyrazolin-5-one ($R_1$: —H, $R_2$: — 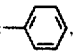 , $R_3$: —H, $R_4$: —H)

Compound 2

1-(p-Iodophenyl)-2,3-dimethyl-3-pyrazolin-5-one ($R_1$: — 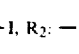 —I, $R_2$: —$CH_3$, $R_3$: —$CH_3$, $R_4$: —H)

Compound 3

2,3,4-Triphenyl-3-pyrazolin-5-one ($R_1$: —H, $R_2$: — 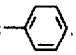 , $R_3$: — 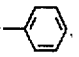 , $R_4$: — 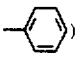 )

-continued

Compound 4

1-Phenyl-2,3-dimethyl-3-pyrazolin-5-one ($R_1$: — 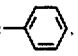 , $R_2$: —$CH_3$, $R_3$: —$CH_3$, $R_4$: —H)

Compound 5

1,3-Diethyl-2-phenyl-3-pyrazolin-5-one ($R_1$: —$C_2H_5$, $R_2$: — 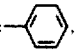 , $R_3$: —$C_2H_5$, $R_4$: —H)

Compound 6

2,3-Dimethyl-1-ethyl-4-isopropyl-3-pyrazolin-5-one ($R_1$: —$C_2H_5$, $R_2$: —$CH_3$, $R_3$: —$CH_3$, $R_4$: —$CH\begin{matrix}CH_3\\CH_3\end{matrix}$)

Compound 7

2-o-Tolyl-3-methyl-4-ethyl-3-pyrazolin-5-one ($R_1$: —H, $R_2$: — 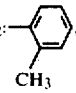 , $R_3$: —$CH_3$, $R_4$: —$C_2H_5$)

Compound 8

2-Cyclohexyl-3-pyrazolin-5-one ($R_1$: —H, $R_2$: — 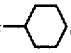 , $R_3$: —H, $R_4$: —H)

Compound 9

2-Methyl-1,3-diphenyl-3-pyrazolin-5-one ($R_1$: — 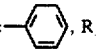 , $R_2$: —$CH_3$, $R_3$: — 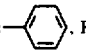 , $R_4$: —H)

Compound 10

1-Cyclohexyl-2,3-dimethyl-3-pyrazolin-5-one ($R_1$: —, $R_2$: —$CH_3$, $R_3$: —$CH_3$, $R_4$: —H)

Of the Compounds 1 to 10, the Compounds 2, 4, 5, 6, 9 and 10 which have a substituent at the 1-position are especially preferred because they can impart good storage stability to the raw dry image forming material.

A dry image forming material containing at least one member selected from the compounds of the aforementioned formula forms thereon a good black tone image. Such a dry image forming material is also excellent in storage stability of the raw image forming material and improved in sensitivity. The amount of the aforementioned component (d) to be used in the dry image forming material of the present invention may be in a broad range of from 0.05 to 3 moles per mole of the non-photosensitive organic silver salt oxidizing agent. The amount of the component (d) varies depending on the kinds of toning agent as the component (d) and other components to be used in the dry image forming material of the present invention, the temperature of heat development to which the resulting dry image forming material is subjected, and the like. The compounds as specified above as the component (d) may be used either alone or in combination.

The compound as the component (d) may be used in combination with the known toning agent such as phthalazinone or succinimide. It has also unexpectedly been found that, when one or more compounds as specified above as the component (d) is used in combination with phthalazinone, the defects inherent in single use of the known toning agent are obviated and, in addition, the results are rather better with respect to sensitivity and storage stability of the resulting raw dry image forming material and the tone of an image to be formed on the resulting dry image forming material than those obtained in the dry image forming material containing the component (d) or known toning agent alone. The amount of phthalazinone that may be used in combination with the component (d) may be in the range of from 0.2 t0 2.0 moles, preferably from 0.5 to 1.5 moles per mole of the compound as the component (d).

According to need, the dry image forming material of the present invention may comprise in addition to the foregoing essential components a variety of known additives such as a binder, an anti-foggant, a spectral sensitizing dye, an anti-halation dye and a background-darkening preventing agent.

The binder is needed for film formation in most cases, but when the organic silver salt oxidizing agent and/or the reducing agent has the function as a binder, the use of a binder may be omitted. Natural or synthetic polymeric substances may be used as the binder. Representative examples of the binder include polyvinyl butyral, polymethyl methacrylate, cellulose acetate, polyvinyl acetate, cellulose acetate propionate, vinyl chloride-vinyl acetate copolymers, polyvinyl alcohol and gelatin. They may be used either alone or in combination. It is suitable that the binder be used in such an amount that the weight ratio of the binder to the organic silver salt oxidizing agent is in the range of from about 0.1 to about 10.

The representative examples of the anti-foggant include benzotriazole, mercury compounds such as mercury acetate and carboxylic acid anhydrides such as tetrachlorophthalic anhydride. The anti-foggant is effective for preventing the dry image forming material of the present invention from bringing about so-called heat fogging which is a phenomenon that the unexposed portions of a dry image forming material are blackened by heating at the time of heat development. The anti-foggant may be used in an amount of from 0.005 to 10 mole %, based on the organic silver salt oxidizing agent.

As the spectral sensitizing dye that is useful for sensitizing a silver halide, there can be mentioned cyanine type dyes, merocyanine type dyes, styryl type dyes and the like.

As the background-darkening preventing agent, there can be mentioned, for example, tetrabromobutane, hexabromocyclohexane and tribromoquinaldine. They may be used in an amount of from 2.5 to 40 mole %, based on the organic silver salt oxidizing agent.

The preferred method of preparing the dry image forming material of this invention is described by way of example as follows. An organic silver salt oxidizing agent is dispersed in a binder solution or emulsion by means of a sand grinder, a mixer, a ball mill or the like. To the resulting dispersion are successively added the other components and optionally various additives. The composition thus obtained is applied onto a support such as a plastic film, a glass plate, a paper or a metal plate, followed by drying, to prepare a dry image fomring material. As the plastic film, there can be mentioned a polyethylene film, a cellulose acetate film, a polyethylene terephthalate film, a polyamide film, a polypropylene film and the like. The dry thickness of the coating as the heat-developable image forming layer may be 1 to 1,000μ, preferably 3 to 20μ. The components of the composition may optionally be applied in two or more separate but contiguous layers. For the purposes of the protection of the heat-developable image forming layer and so on, a top coat may be provided. The material for the top coat may be chosen from among the binder materials as mentioned hereinbefore.

Of the dry image forming materials according to the present invention, the normally photosensitive image forming material can form thereon a visible image when subjected to imagewise exposure to light and heat development which is usually conducted at a temperature of from 80° to 200° C. for 1 to 60 seconds. On the other hand, the normally non-photosensitive image forming material of the present invention can form thereon a visible image when subjected to preliminary heat activation at a temperature of from 70° to 180° C. for 1 to 60 seconds thereby to react the photosensitive silver halide-forming component with part of the organic silver salt oxidizing agent to form in the material the photosensitive silver halide in an amount sufficient to render the material photosensitive, imagewise exposure to light and heat development which is carried out in the same manner as described with respect to the normally photosensitive image forming material.

The dry image forming material characterized by the use of a novel toning agent can form thereon an excellent black tone image after development and is improved in sensitivity and long-storage stability of the raw image forming material.

The normally non-photosensitive dry image forming material according to the present invention has excellent sensitivity and storage stability of the raw image forming material as compared with conventional dry image forming materials of the same type. In general, an image forming material which is excellent in storage stability of the raw image forming material and forms thereon a black tone image tends to be poor in sensitivity. Therefore, it is difficult to provide an image forming material which is excellent in both sensitivity and storage stability. The normally non-photosensitive dry image forming material according to the present invention unexpectedly obviates such a dilemma as mentioned above with the aid of the aforementioned component (d). Further, the normally non-photosensitive dry image forming material according to the present invention tends to be somewhat better in long-storage stability of the raw image forming material in a dark room than the normally photosensitive dry image forming material according to the present invention, as is shown in the following Examples. Furthermore, the normally non-photosensitive dry image forming material according to the present invention is good in storage stability of the raw image forming material even in a light room.

The following Examples illustrate the present invention in more detail but should not be construed as limiting the scope of the invention.

In Examples, the symbol (A) indicates the materials of the present invention and the symbol (B) indicates the comparative materials.

EXAMPLE 1 AND COMPARATIVE EXAMPLE 1

To 22 g of a mixed solvent of toluene and methyl ethyl ketone (mixing weight ratio = 1:2) was added 3 of silver behenate, and the mixture was ball-milled for 15 hours to obtain a homogeneous silver behenate suspension.

To 1.5 g of the silver behenate suspension were successively added ingredients as shown below to form a coating composition. The coating composition was uniformly applied onto a 100μ-thick polyethylene terephthalate film, and the coating was dried at 80° C. for several minutes to obtain a normally photosensitive dry image forming material (A1) having a dry coating layer thickness of about 8μ.

Ingredients

Solution of polyvinyl butyral in methyl ethyl ketone (weight ratio = 1:10)—1.0 g Benzyltrimethylammonium iodide—5 mg 2,2'-Methylenebis(4-ethyl-6-tert-butylphenol)—25 mg 2-Phenyl-3-pyrazolin-5-one (Compound 1)—15 mg Mercuric acetate—0.1 mg For the purpose of comparison with the dry image forming material (A1) of the present invention, a normally photosensitive dry image forming material (B1) was prepared in substantially the same manner as described above except that the use of the Compound 1 was omitted.

Two kinds of the dry image forming materials thus obtained were each closely contacted with a mask film having a gradation and exposed through the mask film to light from a 100 watt tungsten lamp for 1 second. Then, the exposed materials were each heated by contacting the same with a hot metal plate maintained at 100° C. for 10 seconds in a dark room. The material (A1) of the present invention formed thereon a black tone image having a maximum optical density (O.D.max) of 1.65 and a minimum optical density (O.D.min) of 0.07. On the other hand, no image was formed on the comparative material (B1).

EXAMPLE 2

A normally photosensitive dry image forming material (A2) was prepared in substantially the same manner as described in Example 1 except that, instead of the Compound 1, 2,3,4-triphenyl-3-pyrazolin-5-one (Compound 3) was used in the same amount by weight as that of the Compound 1. The material (A2) was subjected to light exposure and heat development in the same manner as described in Example 1 and Comparative Example 1. The material (A2) formed thereon a black tone image having an O.D. max of 1.73 and an O.D. min of 0.07.

EXAMPLE 3 AND COMPARATIVE EXAMPLE 2

Into 10 g of a mixed solvent of toluene and acetone (mixing weight ratio = 1:1) was dissolved 0.6 g of polyvinyl butyral. To the resulting solution was added 3 g of silver behenate, and the mixture was ball-milled for 8 hours to obtain a homogeneous silver behenate suspension.

To 1.5 g of the silver behenate suspension were successively added ingredients as shown below to form a coating composition. The coating composition was uniformly applied onto a 100μ-thick polyethylene terephthalate film and the coating was dried at 80° C. for several minutes to obtain a normally photosensitive dry image forming material (A3) having a dry coating layer thickness of about 10μ.

Ingredients

Solution of polyvinyl butyral in acetone (weight ratio = 1:10)—0.5 g

Calcium bromide—5 mg 2,6-Bis(2'-hydroxy-3'-tert-butyl-5'-methylbenzyl)-4-methylphenol—15 mg 1-Phenyl-2,3-dimethyl-3-pyrazolin-5-one (Compound 4)—15 mg Mercuric acetate—0.1 mg For the purpose of comparison with the dry image forming material (A3) of the present invention, a normally photosensitive dry image forming material (B2) was prepared in substantially the same manner as described above except that the use of the Compound 4 was omitted.

Two kinds of the dry image forming materials thus obtained were each closely contacted with a mask film having a gradation and exposed through the mask film to light from a 100-watt tungsten lamp for ¼ second. Then, the exposed materials were each heated by contacting the same with a hot metal plate maintained at 120° C. for 3 seconds in a dark room. The material (A3) of the present invention formed thereon a black tone image having an O.D. max of 1.78 and an O.D. min of 0.08. On the other hand, no image was formed on the comparative material (B2), the unexposed background of which assumed a light-brown color.

EXAMPLE 4

Normally photosensitive dry image forming materials (A4) and (A5) were prepared in substantially the same manner as described in Example 3 except that, instead of the Compound 4, 2,3-dimethyl-1-ethyl-4-isopropyl-3-pyrazolin-5-one (Compound 6) and 1-cyclohexyl-2,3-dimethyl-3-pyrazolin-5-one (Compound 10) were respectively used in the same amount by weight as that of the Compound 4. The dry image forming materials obtained were each subjected to light exposure and heat development in the same manner as described in Example 3 and Comparative Example 2. The material (A4) formed thereon a black tone image having an O.D. max of 1.62 and an O.D. min of 0.07. The material (A5) formed thereon a black tone image having an O.D. max of 1.70 and an O.D. min of 0.07.

EXAMPLE 5 AND COMPARATIVE EXAMPLE 3

To 1.5 g of a silver behenate suspension as prepared in the same manner as described in Example 1 and Comparative Example 1 were successively added 1.0 g of a solution of polyvinyl butyral in methyl ethyl ketone (weight ratio = 1:10), 5 mg of barium iodide and 0.1 mg of mercuric acetate to prepare a silver behenate emulsion. Then, the silver behenate emulsion thus obtained was applied onto a 100μ-thick polyethylene terephthalate film and dried in the same manner as described in Example 1.

About 2 g of a reducing layer-forming composition composed of ingredients as shown below were uniformly applied as a second layer onto the silver behenate emulsion layer so prepared, and dried at 80° C. for several minutes to form a normally photosensitive dry image forming material (A6) having a total coating layer thickness of about 15μ.

Ingredients

Polymethyl methacrylate—10 g 2,2'-Methylenebis(4-methyl-6-tertbutylphenol)—3.4 g 2-o-Tolyl-3-methyl-4-ethyl-3-pyrazolin-5-one (Compound 7)—1.5 g Acetone—80 g For the purpose of comparison with the dry image forming material (A6) of the present invention, normally photosensitive dry image forming materials (B3)

and (B4) were prepared in substantially the same manner as described above except that, instead of the Compound 7, phthalazinone and 3-methyl-2-pyrazolin-5-one as mentioned in U.S. Pat. No. 3,846,136 were respectively used in the same amount by weight as that of the Compound 7.

Respective samples of three kinds of the dry image forming materials thus obtained were each closely contacted with a mask film having a gradation and exposed through the mask film to light from a 100 watt tungsten lamp for 1 second. Then, the exposed samples were each heated at 100° C. for 5 seconds by passing the same through hot rolls in a dark room. All of the samples formed thereon good black tone images.

On the other hand, samples of the raw image forming materials (A6), (B3) and (B4) were stored in a dark room for 3 months to examine the storage stability. Then, the samples were each subjected to light exposure and heat development in the same manner as described above. The sample of the material (A6) of the present invention formed thereon a good black tone image. The sample of the comparative material (B3) formed thereon an image which, however, had a degraded black tone. The sample of the comparative material (B4) brought about heat fogging with a light-brown color in the unexposed portions.

The results obtained are shown in Table 1.

TABLE 1

| Material No. | Just after preparation O.D. max | Just after preparation O.D. min | After three months' storage O.D. max | After three months' storage O.D. min |
|---|---|---|---|---|
| A6 | 1.73 | 0.08 | 1.79 | 0.08 |
| B3 | 1.78 | 0.08 | 1.43 | 0.16 |
| B4 | 1.76 | 0.10 | 1.72 | 0.31 |

The sample of the raw image forming material (A6) was stored in a dark room at 20° C. for 6 months. Then, the sample was subjected to light exposure and heat development in the same manner as described above to form an image having an O.D. max of 1.75 and an O.D. min of 0.11. Thus, a slight increase in O.D. min was observed.

EXAMPLE 6

A normally photosensitive dry image forming material (A7) was prepared in substantially the same manner as described in Example 5 except that, instead of the Compound 7, 2-cyclohexyl-3-pyrazolin-5-one (Compound 8) was used in the same amount by weight as that of the Compound 7. The material (A7) was subjected to light exposure and heat development in the same manner as described in Example 5 and Comparative Example 3. The material (A7) formed thereon a good black tone image having an O.D. max of 1.70 and an O.D. min of 0.08.

EXAMPLE 7

A normally photosensitive dry image forming material (A8) was prepared in substantially the same manner as described in Example 1 except that, instead of silver behenate, silver stearate was used in the same amount by weight as that of the silver behenate. The material (A8) was subjected to light exposure and heat development in the same manner as described in Example 1 and Comparative Example 1. The material (A8) formed thereon a black tone image having an O.D. max of 1.76 and an O.D. min of 0.08.

EXAMPLE 8

To 1.5 g of a silver behenate suspension as prepared in the same manner as described in Example 1 and Comparative Example 1 were successively added 1.0 g of a solution of polyvinyl butyral in methyl ethyl ketone (weight ratio = 1:10), 5 mg of iodine and 1 mg of mercuric acetate to prepare a silver behenate emulsion.

The silver behenate emulsion was uniformly applied onto a 100μ-thick polyethylene terephthalate film, and the coating was sufficiently dried at a room temperature of about 20° C. About 2 g of a reducing layer-forming composition composed of ingredients as shown below were uniformly applied as a second layer onto the about 8μ-thick silver behenate emulsion layer so prepared, and dried at room temperature for several minutes to form a normally non-photosensitive dry image forming material (A9) having a total coating layer thickness of about 15μ.

Ingredients

Polymethyl methacrylate—10 g 2,6-Bis(2'-hydroxy-3'-tert-butyl-5'-methylbenzyl)-4-methylphenol—3.4 g 1-Phenyl-2,3-dimethyl-3-pyrazolin-5-one (Compound 4)—1.5 g Acetone—80 g The dry image forming material (A9) was preliminarily heated at 100° C. for 5 seconds, and was then exposed through a mask film having a gradation to light from a 100 watt tungsten lamp for 1 second. Then, the exposed material was heated by contacting the same with a hot metal plate maintained at 120° C. for 3 seconds in a dark room. The material (A9) formed thereon a black tone image having an O.D. max of 1.94 and an O.D. min of 0.06.

EXAMPLE 9 AND COMPARATIVE EXAMPLE 4

A normally non-photosensitive dry image forming material (A9) was prepared in the same manner as described in Example 8. A normally non-photosensitive dry image forming material (A10) was prepared in substantially the same manner as described in Example 8 except that, instead of the Compound 4, a mixture of the Compound 4 and phthalazinone (mixing weight ratio = 1:1) was used in the same amount by weight as that of the Compound 4. A normally non-photosensitive dry image forming material (B5) was prepared in substantially the same manner as described in Example 8 except that, instead of the Compound 4, phthalazinone was used as an ingredient of the second layer in the same amount by weight as that of the Compound 4.

With respect to the dry image forming materials (A9), (A10) and (B5) thus prepared, respective samples just after preparation, after 3 months' storage at 20° C. in a dark room and after 6 months' storage at 20° C. in a dark room were preliminarily heated at 100° C. for 5 seconds, exposed through a mask film having a gradation to light from a 100 watt tungsten lamp for ½ second, and heated by contacting the same with a hot metal plate maintained at 120° C. for 3 seconds in a dark room to effect heat development.

The results obtained with respect to optical density of image and relative sensitivity (R.S.) are shown in Table 2. Relative sensitivity was defined to indicate a ratio of sensitivity (the reciprocal of amount of exposure light required for giving an O.D. of 1) to the sensitivity of the dry image forming material (A9) just after preparation thereof, the relative sensitivity of which was, therefore, defined as 1.

TABLE 2

| Material | Just after preparation | | | After 3 months' storage | | | After 6 months' storage | | |
|---|---|---|---|---|---|---|---|---|---|
| No. | R.S. | O.D. max | O.D. min | R.S. | O.D. max | O.D. min | R.S. | O.D. max | O.D. min |
| A9 | 1 | 1.42 | 0.07 | 0.97 | 1.40 | 0.08 | 1.0 | 1.43 | 0.07 |
| A10 | 1.9 | 2.05 | 0.07 | 1.8 | 1.88 | 0.08 | 2.0 | 1.94 | 0.08 |
| B5 | 1.3 | 1.60 | 0.07 | 1.1 | 1.41 | 0.09 | 0.85 | 1.23 | 0.15 |

As can be seen in Table 2, the materials (A9) and (A10) of the present invention showed excellent storage stability, and the material (A10) was more excellent in sensitivity than the material (A9). The comparative material (B5) showed such a disadvantageous tendency that, with the lapse of storage time, the sensitivity decreased, the minimum optical density increased little by little and the clarity and black tone of the image formed decreased with the increase in brownish tone of the image. The materials (A9) and (A10) did not show such a disadvantageous tendency as the material (B5) did.

EXAMPLE 10

To 1.5 g of a silver behenate suspension as prepared in the same manner as described in Example 1 were successively added 1.0 g of a solution of polyvinyl butyral in methyl ethyl ketone (weight ratio=1:10), 5 mg of iodine, 1 mg of mercuric acetate and 15 mg of 1-phenyl-2,3-dimethyl-3-pyrazolin-5-one (Compound 4) to prepare a silver behenate emulsion.

Then, the silver behenate emulsion was uniformly applied onto a 100μ-thick polyethylene terephthalate film, and the coating was sufficiently dried at a room temperature of about 20° C. About 2 g of a reducing layer-forming composition composed of ingredients as shown below were uniformly applied as a second layer onto the about 8μ-thick silver behenate emulsion layer so prepared, and dried at room temperature for several minutes to form a normally non-photosensitive dry image forming material (A11) having a total coating layer thickness of about 15μ.

Ingredients

Polymethyl methacrylate—10 g
2,2'-Methylenbis(4-ethyl-6-tert-butylphenol)—3.4 g
Methyl ethyl ketone—80 g On the other hand, a normally non-photosensitive dry image forming material (A12) was prepared in substantially the same manner as described above except that 1.5 g of phthalazinone was further added as an ingredient of the second layer to the above-mentioned ingredients.

With respect to the dry image forming materials (A11) and (A12) thus prepared, respective samples just after preparation, after 3 months' storage at 20° C. in a dark room and after 6 months' storage at 20° C. in a dark room were preliminarily heated at 100° C. for 3 seconds, exposed through a mask film having a gradation to light from a 100 watt tungsten lamp for ¼ second, and heated by contacting the same with a hot metal plate maintained at 125° C. for 3 seconds in a dark room to effect heat development.

The results obtained with respect to optical density of image and relative sensitivity (R.S.) are shown in Table 3. Relative sensitivity was defined to indicate a ratio of sensitivity (the reciprocal of amount of exposure light required for giving an O.D. of 1) to the sensitivity of the dry image forming material (A11) just after preparation thereof, the relative sensitivity of which was, therefore, defined as 1.

TABLE 3

| Material | Just after preparation | | | After 3 months' storage | | | After 6 months' storage | | |
|---|---|---|---|---|---|---|---|---|---|
| No. | R.S. | O.D. max | O.D. min | R.S. | O.D. max | O.D. min | R.S. | O.D. max | O.D. min |
| A11 | 1 | 1.51 | 0.06 | 0.96 | 1.50 | 0.07 | 1.0 | 1.55 | 0.06 |
| A12 | 1.6 | 1.97 | 0.07 | 1.5 | 2.03 | 0.06 | 1.6 | 2.00 | 0.07 |

EXAMPLE 11

A normally non-photosensitive dry image forming material (A13) was prepared in substantially the same manner as described in Example 8 except that 10 mg of N-bromosuccinimide was used in place of 5 mg of iodine. The material (A13) was preliminarily heated in a dark room at 100° C. for 5 seconds, and was then exposed through a mask film having a gradation to light from a 100 watt tungsten lamp for 2 seconds. Then, the exposed material was heated by contacting the same with a hot metal plate maintained at 120° C. for 5 seconds in a dark room. The material (A13) formed thereon a black tone image having an O.D.max of 1.52 and an O.D.min of 0.08.

EXAMPLE 12

Normally non-photosensitive dry image forming materials (A14), (A15), (A16) and (A17) were prepared in substantially the same manner as described in Example 8 except that, instead of the Compound 4, 2-phenyl-3-pyrazolin-5-one (Compound 1), 1-(p-iodophenyl)-2,3-dimethyl-3-pyrazolin-5-one (Compound 2), 2-o-tolyl-3-methyl-4-ethyl-3-pyrazolin-5-one (Compound 7) and 2-methyl-1,3-diphenyl-3-pyrazolin-5-one (Compound 9) were respectively used in the same amount by weight as that of the Compound 4.

With respect to the dry image forming materials (A14), (A15), (A16) and (A17) thus prepared, respective samples just after preparation and after 6 months' storage at 20° C. in a dark room were preliminarily heated at 100° C. for 5 seconds, exposed through a mask film having a gradation to light from a 100 watt tungsten lamp for ½ second, and heated by contacting the same with a hot metal plate maintained at 120° C. for 3 seconds in a dark room to effect heat development.

All of the materials just after preparation formed thereon a black tone image having substantially the same O.D.max and O.D.min as those obtained with respect to the material (A9) just after preparation in Example 9.

All of the materials after 6 months' storage at 20° C. in a dark room formed thereon a black tone image having substantially the same O.D.max as that obtained with respect to the materials just after preparation and an O.D.min listed below with respect to the respective materials.

Material (A14): O.D.min=0.09
Material (A15): O.D.min=0.07
Material (A16): O.D.min=0.09
Material (A17): O.D.min=0.07

EXAMPLE 13

A normally photosensitive dry image forming material (A18) was prepared in substantially the same manner as described in Example 1 except that, instead of the Compound 1, a 1:1 by weight mixture of 2-phenyl-3-pyrazolin-5-one (Compound 1) and 1,3-diethyl-2-phenyl-3-pyrazolin-5-one (Compound 5) was used in the same amount by weight as that of the Compound 1. The material (A18) was subjected to light exposure and heat development in the same manner as described in Example 1 and Comparative Example 1. The material (A18) of the present invention formed thereon a black tone image having an O.D. max of 1.75 and an O.D.min of 0.07.

What is claimed is:

1. In a dry image forming composition consisting essentially of (a) a non-photosensitive organic silver salt oxidizing agent, (b) a reducing agent for silver ions, (c) a photosensitive silver halide or a photosensitive silver halide-forming component capable of forming a photosensitive silver halide by the reaction thereof with said organic silver salt oxidizing agent, and (d) a toner, the improvement which comprises employing as said toner (d) at least one member selected from the group consisting of compounds represented by the formula

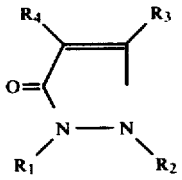

wherein $R_1$ is a hydrogen atom, a $C_1$–$C_5$ straight chain or branched alkyl group, an unsubstituted or substituted phenyl group or an unsubstituted or substituted $C_3$–$C_8$ cycloalkyl group; $R_2$ is a $C_1$–$C_5$ straight chain or branched alkyl group, an unsubstituted or substituted phenyl group or an unsubstituted or substituted $C_3$–$C_8$ cycloalkyl group; and $R_3$ and $R_4$ are the same or different and each represent a hydrogen atom, a $C_1$–$C_5$ straight chain or branched alkyl group, an unsubstituted or substituted phenyl group or an unsubstituted or substituted phenylakyl group having a $C_1$–$C_5$ straight chain or branched alkyl moiety.

2. A dry image forming material as claimed in claim 1, wherein the component (d) is present in about 0.05 to 3 moles per mole of (a) and is at least one member selected from the group consisting of compounds represented by the formula:

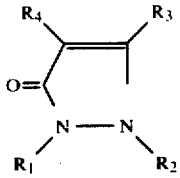

wherein $R_1$ is a hydrogen atom, a methyl group, an ethyl group, a phenyl group, a substituted phenyl group substituted with 1 to 3 substituents selected from methyl, ethyl, chlorine, bromine and iodine, or a cyclohexyl group; $R_2$ is a methyl group, an ethyl group, a phenyl group, a substituted phenyl group substituted with 1 to 3 substituents selected from methyl, ethyl, chlorine, bromine and iodine, or a cyclohexyl group; $R_3$ is a hydrogen atom, a methyl group, an ethyl group or a phenyl group; and $R_4$ is a hydrogen atom, a methyl group, an ethyl group, an isopropyl group, a phenyl group, a p-methylphenyl group or a benzyl group.

3. A dry image forming material as claimed in claim 1 or 2, wherein the component (d) is selected from 1-(p-iodophenyl)-2,3-dimethyl-3-pyrazolin-5-one, 1-phenyl-2,3-dimethyl-3-pyrazolin-5-one, 1,3-diethyl-2-phenyl-3-pyrazolin-5-one, 2,3-dimethyl-1-ethyl-4-isopropyl-3-pyrazolin-5-one, 2-methyl-1,3-diphenyl-3-pyrazolin-5-one and 1-cyclohexyl-2,3-dimethyl-3-pyrazolin-5-one.

4. A dry image forming material as claimed in any of claims 1 to 3, wherein the component (d) is used in combination with phthalazinone.

5. A dry image forming material as claimed in any of claims 1 to 4, wherein the component (a) is the silver salt of a long chain fatty acid and the component (b) is a hindered phenol.

6. A dry image forming material as claimed in any of claims 1 to 5, wherein the component (c) is a photosensitive silver halide-forming component comprising at least one member selected from the group consisting of organic haloamides, halogen molecular species and complexes thereof, organometallic halides and diarylhalomethanes, and which is non-photosensitive under normal lighting conditions.

7. A dry image forming material according to claim 2 wherein 0.1 to 50 g of (a) are present per $m^2$ of the area of the material, and based on the oxidizing agent 0.1 to 3 moles of (b) and 0.001 to 0.3 mole of (c) are present.

* * * * *